US008127553B2

(12) United States Patent
Ekkad et al.

(10) Patent No.: US 8,127,553 B2
(45) Date of Patent: Mar. 6, 2012

(54) ZERO-CROSS-FLOW IMPINGEMENT VIA AN ARRAY OF DIFFERING LENGTH, EXTENDED PORTS

(75) Inventors: Srinath Varadarajan Ekkad, Blacksburg, VA (US); Eric Ian Esposito, Geismar, LA (US); Yong Weon Kim, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 713 days.

(21) Appl. No.: 12/038,504

(22) Filed: Feb. 27, 2008

(65) Prior Publication Data

US 2008/0271458 A1 Nov. 6, 2008

Related U.S. Application Data

(60) Provisional application No. 60/892,348, filed on Mar. 1, 2007.

(51) Int. Cl.
*F23R 3/04* (2006.01)

(52) U.S. Cl. ..... 60/752; 60/754; 60/755; 60/759; 431/160; 416/95; 165/908

(58) Field of Classification Search ..... 60/752, 60/754, 755, 756, 758, 760, 759; 416/95; 165/908; 431/160
See application file for complete search history.

(56) References Cited

U.S. PATENT DOCUMENTS 4,916,906 A * 4/1990 Vogt ..... 60/757

(Continued)

OTHER PUBLICATIONS

Esposito, E.. et al.,"Corrugated Wall Jet Impingement Geometry for Combustor Liner Backside Cooling," ASME IMECE2006-13300, ASME IMECE Conference (Nov. 2006).

(Continued)

*Primary Examiner* — Ehud Gartenberg
*Assistant Examiner* — Steven Sutherland
(74) *Attorney, Agent, or Firm* — Finnegan, Henderson, Farabow, Garrett & Dunner LLP

(57) ABSTRACT

A jet impingement array design and method are disclosed for efficiently cooling the liner of a gas turbine combustion chamber, while eliminating almost all effects of coolant gas crossflow. The design includes an array of extended jet ports for which the distance between the ends of the jet ports and the surface to be cooled progressively decreases from upstream to downstream. Spent air from upstream jets is directed away from downstream jets, thereby reducing the detrimental effects of crossflow, and optimizing heat transfer.

19 Claims, 6 Drawing Sheets

U.S. PATENT DOCUMENTS

| | | | | |
|---|---|---|---|---|
| 5,586,866 | A | 12/1996 | Wettstein | 416/96 |
| 6,000,908 | A | 12/1999 | Bunker | 416/95 |
| 6,237,344 | B1 | 5/2001 | Lee | 60/754 |
| 6,484,505 | B1 * | 11/2002 | Brown et al. | 60/760 |
| 2005/0097890 | A1 * | 5/2005 | Ikeda et al. | 60/748 |

OTHER PUBLICATIONS

Gao, L. et al., "Impingement Heat Transfer, Part I: Linearly Stretched Arrays of Holes," AIAA Journal of Thermophysics and Heat Transfer, vol. 19, No. 1, pp. 57-65 (2005).

* cited by examiner

ZERO-CROSS-FLOW IMPINGEMENT VIA AN ARRAY OF DIFFERING LENGTH, EXTENDED PORTS

The benefit of the Mar. 1, 2007 filing date of provisional patent application No. 60/892,348 filed Mar. 1, 2007 is claimed under 35 U.S.C. §119(e).

This application pertains to a method and device for cooling hot surfaces, such as those associated with gas turbine liners, heat exchangers, and electronic chip manufacturing units.

Gas turbine liners require substantial cooling since they are exposed to both convective and radiative heating from the combustion process. A typical gas turbine comprises a combustion chamber, an inner liner exposed to hot gases, an outer shell used to separate the hot liner from surrounding engine parts, and a passage for coolant air between the inner liner and outer shell. Various methods to cool the inner liner, including film cooling and jet impingement cooling, have been used.

Film cooling effectively controls temperatures in gas turbines, removing substantial heat with minimal coolant air. Film cooling absorbs the heat load on the inner liner by allowing coolant air to pass along the back of the liner, and then to enter the combustion chamber through holes, thereafter flowing along the inner wall. Upon entering the combustion chamber, the coolant mixes with hot combustion gasses, decreasing the near-wall temperature of the gas. As a result, convective heat flux into the combustor liner is also decreased.

Film cooling, however, adversely affects the combustion process, leading to increased emissions. The air/fuel mixture entering the combustor is initially fuel-rich since additional air is added from the coolant air entering through the liner walls, which mixes with the mainstream air during combustion. This process appears to lead to non-uniform temperature distributions along the liner, causing incomplete combustion and increased production of $NO_x$, CO, and unburned hydrocarbon (HC).

Gas turbines also may be cooled, while still maintaining low emissions, by preventing the mixing of coolant air with mainstream air by using jet impingement arrays. This approach comprises cooling the back of the inner liner. While jet impingement arrays have been used effectively to cool the liner, they also present efficiency problems. Crossflow from spent air from upstream jets appears to degrade the heat transfer capability of the downstream air jets. Thus, cooling efficiency is decreased downstream.

Cooling of the combustor liner from the back may be improved by using enhanced heat transfer augmentation methods. For example, the geometrical parameters of the arrays may alter heat transfer characteristics of impinging jets. Nozzle geometry, jet-to-jet spacing within the arrays of impinging air jets, square arrays versus round air jets, and the effects of dense arrays versus sparse arrays have been examined.

Alternate surface geometries, such as trip strips, protrusions, or dimples, also have been found to alter heat transfer. It appears that alteration of surface geometry disrupts boundary layers, which causes an increase in local turbulence.

In addition, corrugated wall designs have been used to trap spent air between impingement jets to reduce crossflow effects on downstream jets (Esposito, E., Ekkad, S. V., Dutta, P., Kim, Y. W., Greenwood, S., 2006, "Corrugated Wall Jet Impingement Geometry for Combustor Liner Backside Cooling," ASME IMECE2006-13300, ASME IMECE Conference, November 2006).

Gao et al. found that crossflow could be reduced by stretching the arrays. This method comprises using dense arrays where crossflow was minimal, and less dense arrays with larger jet holes downstream where crossflow effects increased (Gao, L., Ekkad, S. V., and Bunker, R. S., 2005, "Impingement Heat Transfer, Part I: Linearly Stretched Arrays of Holes," *AIAA Journal of Thermophysics and Heat Transfer*, January, Vol. 19, No. 1, pp. 57-65).

Bunker (U.S. Pat. No. 6,000,908) disclosed a coolable double-walled structure including a jet-issuing wall and a target wall at a constant distance from the jet-issuing wall to improve cooling efficiency.

Lee (U.S. Pat. No. 6,237,344) disclosed an impingement baffle in the form of a plate with dimples adjacent to the impingement holes to improve cooling efficiency.

Wettstein (U.S. Pat. No. 5,586,866) disclosed a baffle cooling arrangement with multiple baffle tubes so that the end of the baffle tubes remain at a constant distance from a curved target wall.

None of the methods or devices presently available for gas turbines for cooling the back of the liner has overcome inefficiencies in heat transfer caused by crossflow. Thus, there is an unfilled need for a more efficient jet array heat exchanger system for cooling inner liners of gas turbine engine combustors, without causing an increase in emission of $NO_x$, CO, or HC.

We have discovered a novel jet impingement array design and method for efficiently cooling a liner of a gas turbine combustion chamber while eliminating almost all effects of crossflow. The novel design includes an array of extended jet ports for which the distance between the ends of the jet ports and the surface to be cooled is progressively decreased from upstream to downstream. While not wishing to be bound by this theory, this method appears to cause spent air from upstream jets to be directed away from downstream jets, thereby reducing the detrimental effects of crossflow, and optimizing heat transfer, without increased emissions of $NO_x$, CO or HC.

The Reynolds number, $Re_d$, is here defined as the non-dimensional mass flow parameter, $$Re_d = \frac{Ud}{\nu},$$

wherein U=the fluid density multiplied by the fluid velocity passing through a hole with a diameter d; and v=the viscosity of the fluid. The Nusselt number, $Nu_d$ is defined as the non-dimensional heat transfer parameter, $$Nu_d = \frac{hd}{k_{air}}$$

wherein h=the local heat transfer coefficient, d=the jet hole diameter, and k=the thermal conductivity of air. Higher Nusselt numbers indicate better heat transfer.

The distance between jet ports within an array may vary from about 1.3 cm to about 3.8 cm, preferably between about 1.9 cm and 2.5 cm. The jet port diameters may vary from about 0.08 cm to about 3.8 cm, preferably between about 0.25 cm and 2.5 cm. The channel diameter may vary from about 2 times the jet port diameter to about 8 times the jet port diameter. The channel diameter typically varies from about 1.9 cm to about 8.9 cm, depending on the type of combustion chamber, and more typically varies from about 2.5 cm to about 5.0 cm. The length of the jet ports varies in relation to the diameter of the jet ports and the channel diameter. The first port is typically approximately flush with the outer shell, and the last or longest jet port is typically about 1.9 cm. Preferably, the jet port length should be between about 2 times and about 3.5 times the diameter of the jet port. The number of jet ports typically may vary from about 5 to about 20, depending on the size of the combustion chamber, preferably from about 7 to about 12 jet ports.

For example, in a prototype device, the port diameter was 0.64 cm, the number of ports was 10, and the space between the liner and shell was about 3.8 cm. The first jet port was approximately flush with the shell, and the jet port length increased by 0.19 cm for each successive port. The last jet port was about 1.9 cm long.

The efficiency of the novel design was compared to a corrugated wall design, as described above (Esposito, et al, supra), and a constant length extended port configuration. The novel design was examined at three different Reynolds numbers. The novel variable extended port geometry resulted in about a 40%-50% improvement of heat transfer at the $10^{th}$ downstream port. If this novel port design were to be used with corrugated walls, the combination is expected to produce additional improvements. Staggering the jet ports instead of keeping jet ports in line may also show improved efficiency in heat transfer.

Figure 1A:
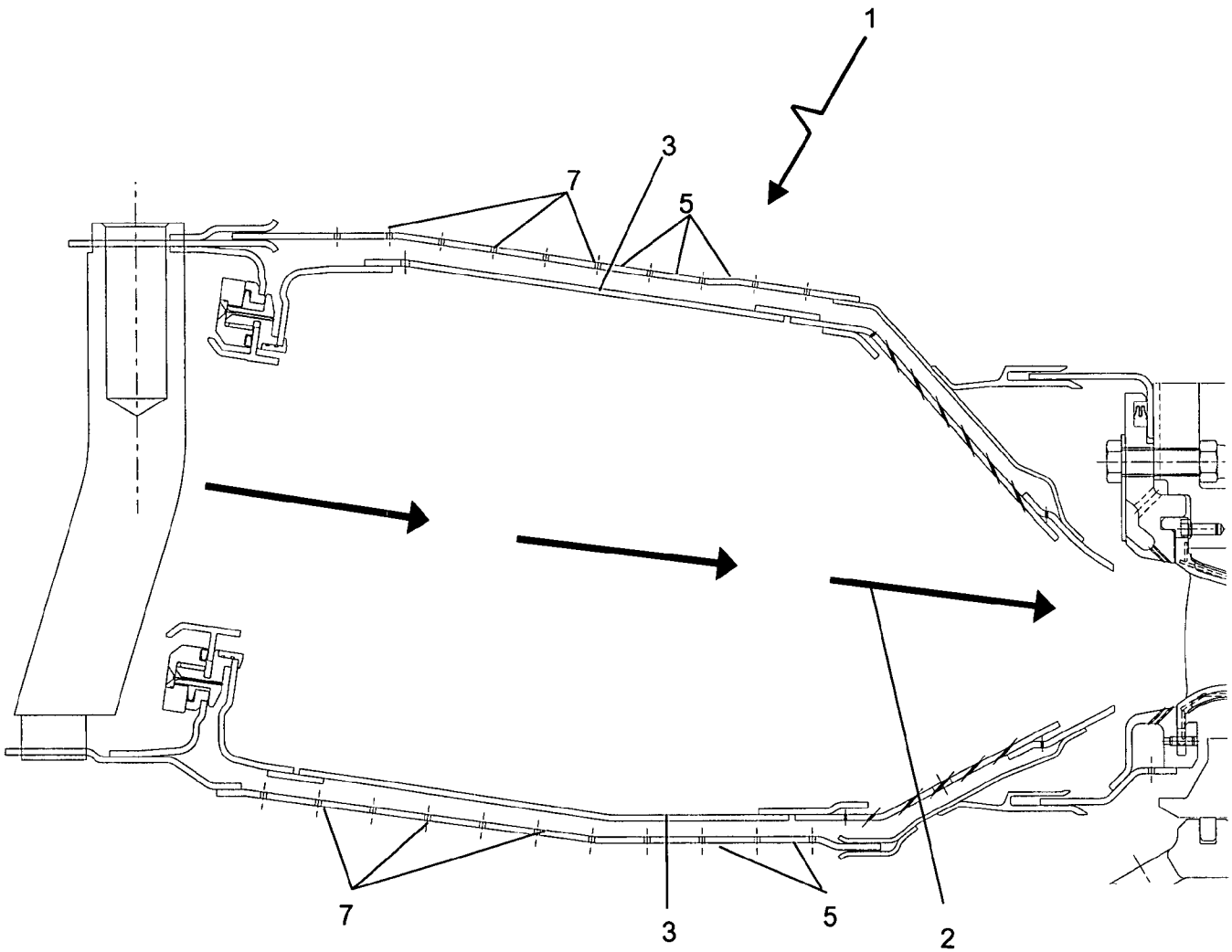
FIG. 1A schematically depicts a typical turbine combustion chamber.
Figure 1B:
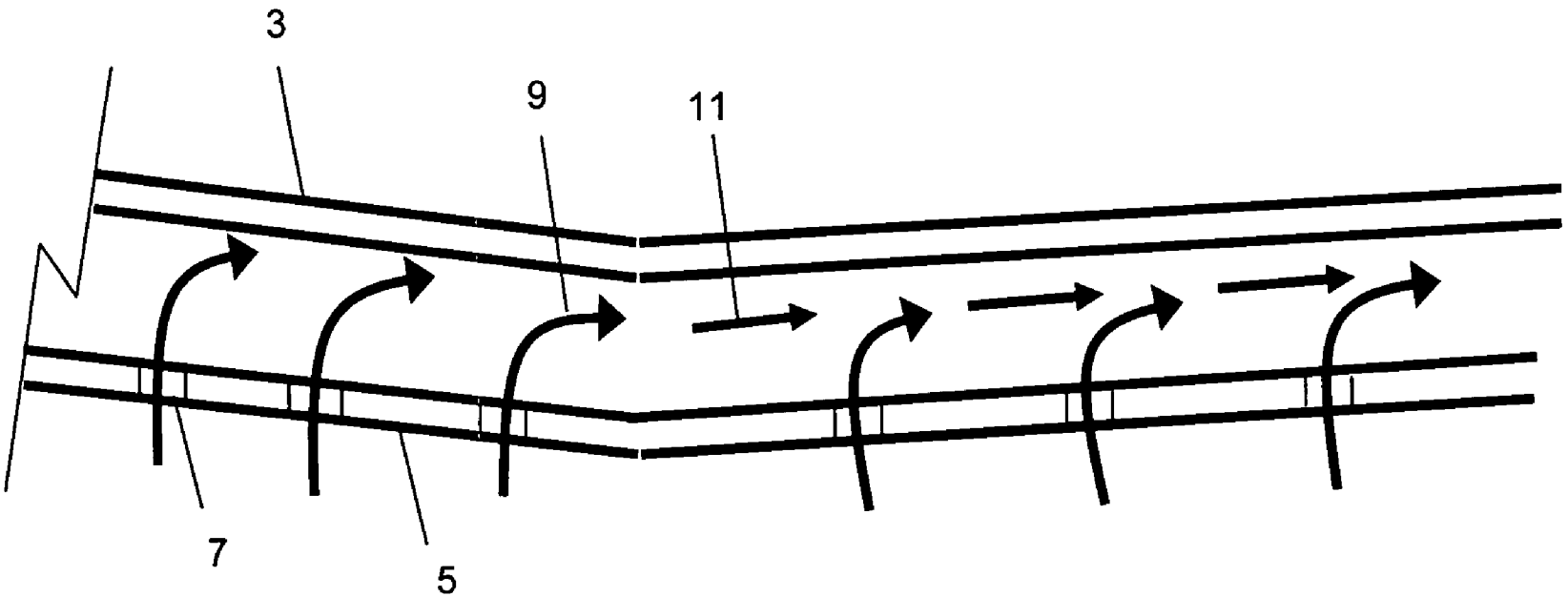
FIG. 1B schematically depicts an expansion of one wall of a turbine combustion chamber, showing a channel between the liner and the shell.
Figure 2:
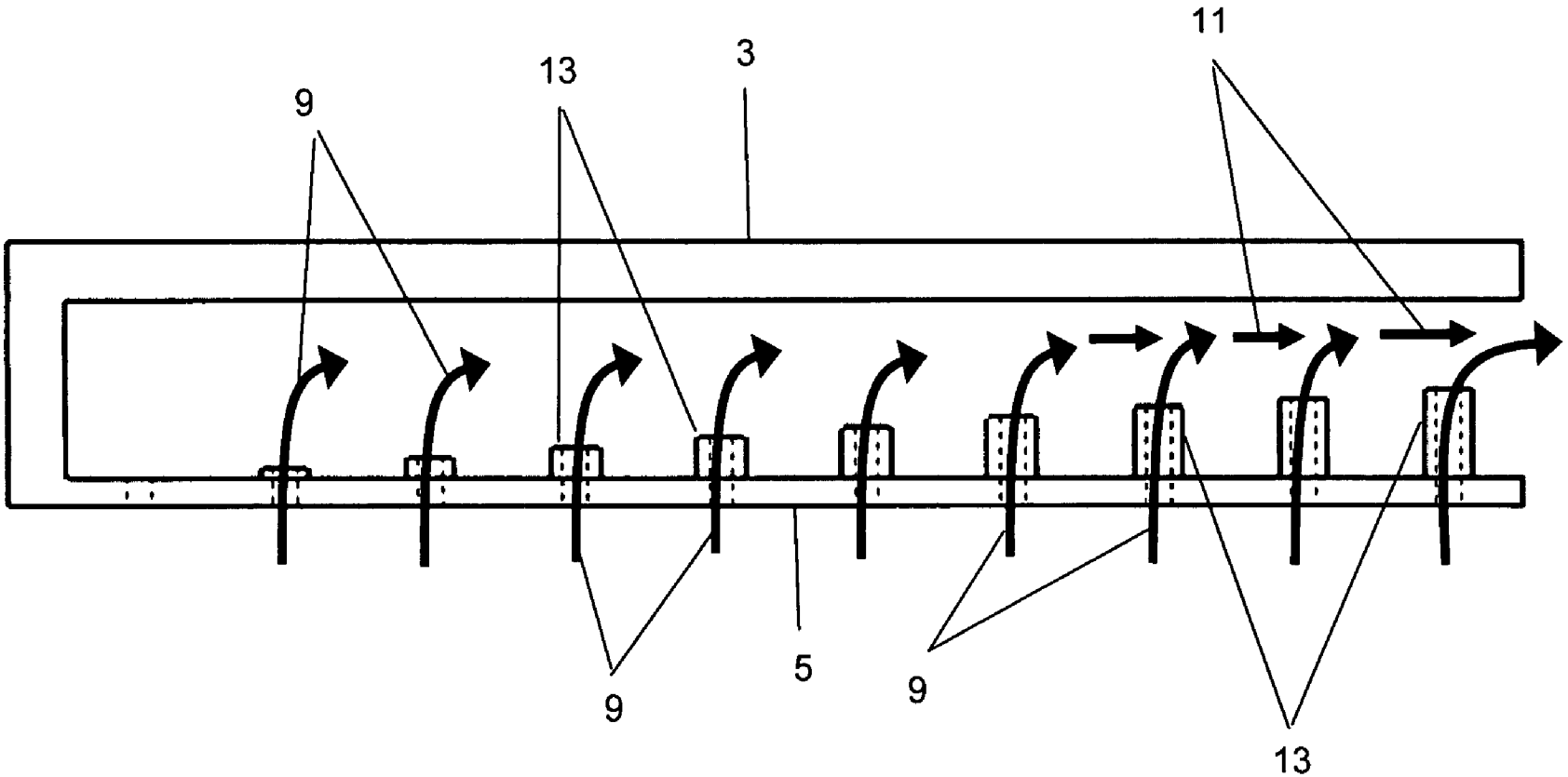
FIG. 2 depicts a jet port array with variable extended port geometry.

A schematic configuration for a gas turbine (1) is shown in FIG. 1A. Liner (3), shown in FIG. 1A, is expanded in FIG. 1B. FIG. 1A also shows the flow of combustion gases (2). As can be seen in FIGS. 1A and 1B the ports (7) that bring cooling gas to the liner are positioned along the full length of shell (5). FIG. 2 shows the liner with variable extended ports (13). The extended ports are longer toward the downstream end of the liner. Also shown is the input of coolant (9) and crossflow (11).

Figure 3:
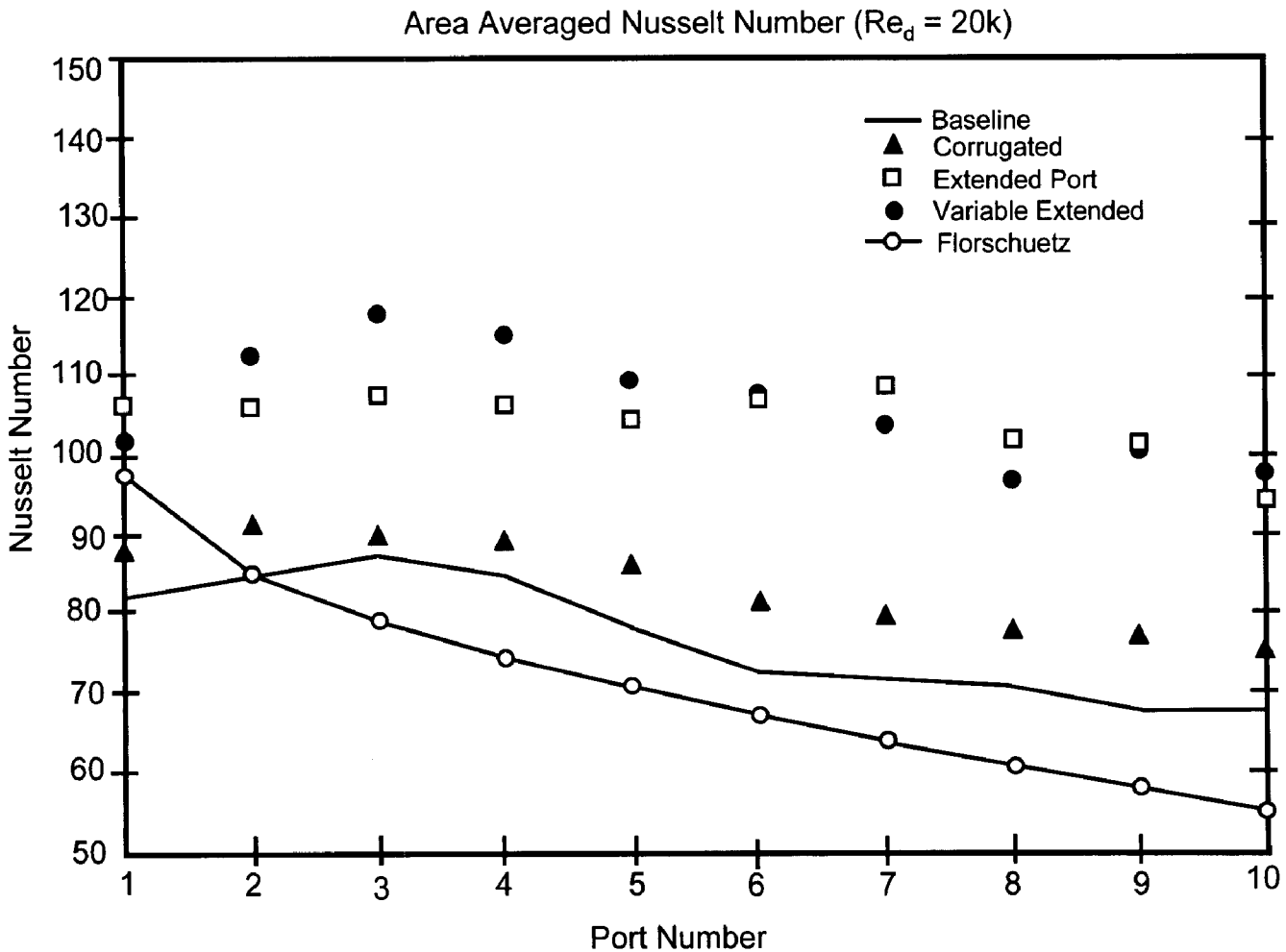
FIG. 3 depicts a comparison of area-averaged Nusselt numbers for Re=20000.
Figure 4:
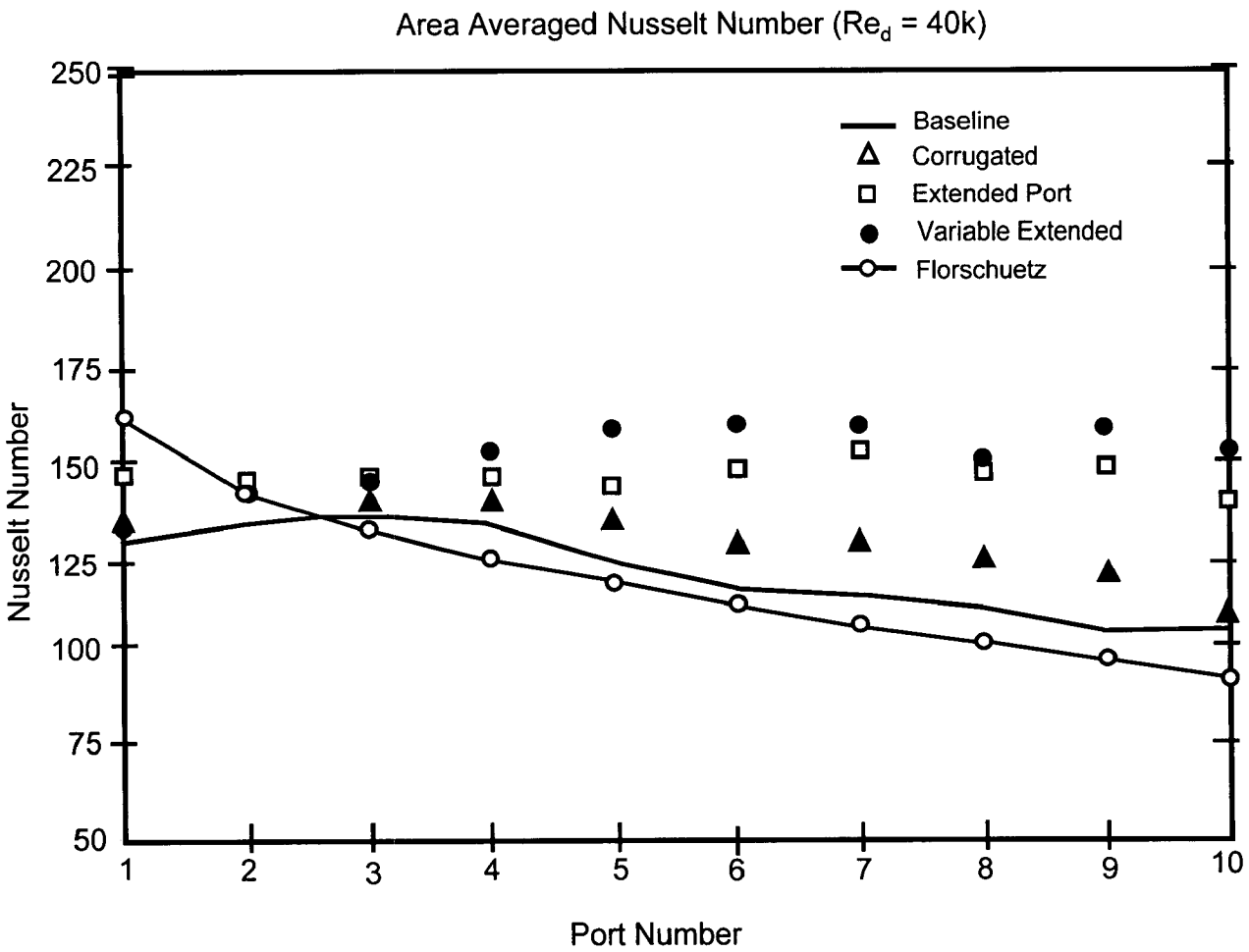
FIG. 4 depicts a comparison of area-averaged Nusselt numbers for Re=40000.
Figure 5:
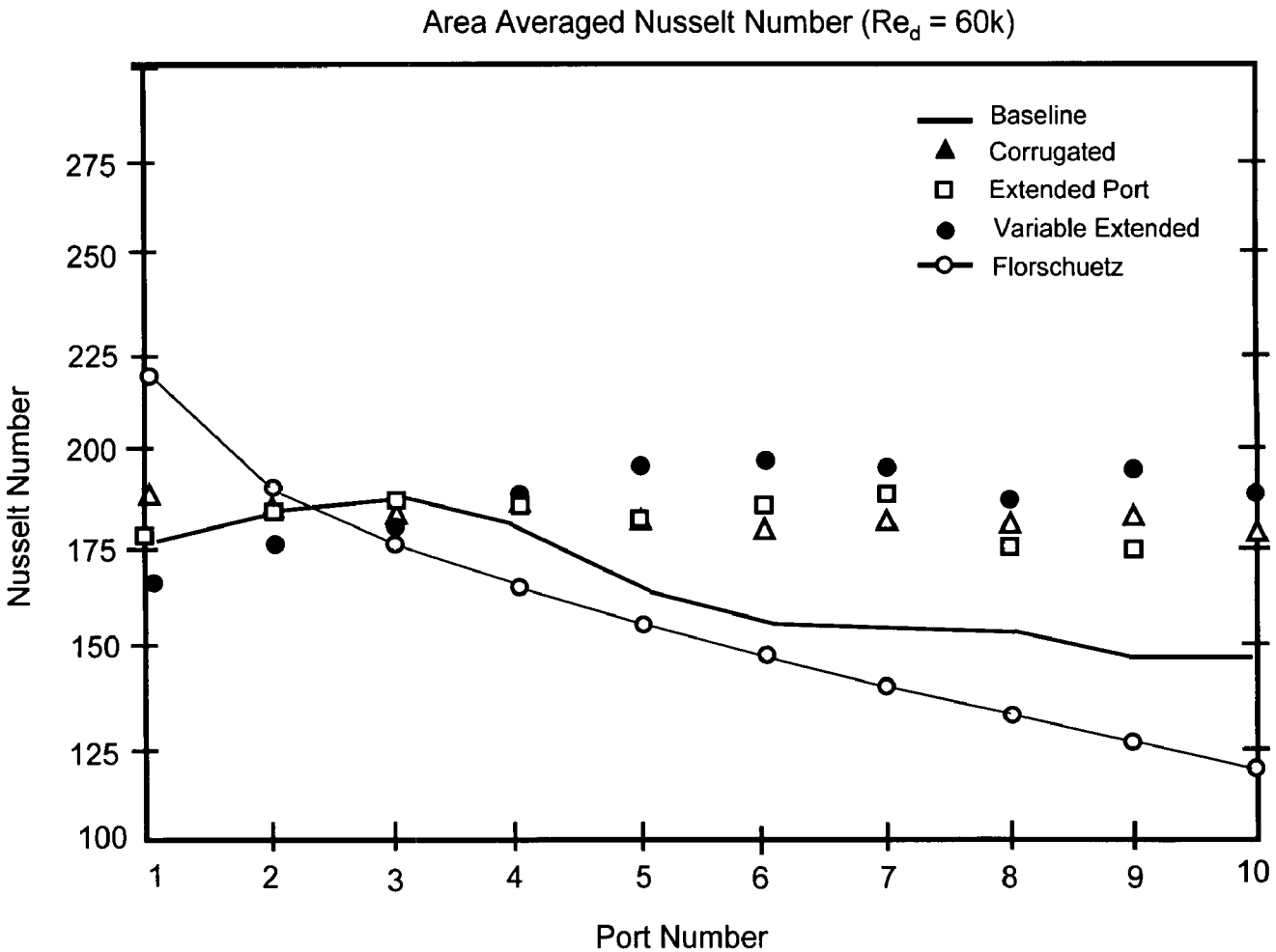
FIG. 5 depicts a comparison of area-averaged Nusselt numbers for Re=60000.

FIGS. 3-5 depict a comparison at different Reynolds numbers of measured heat transfer for different port designs. The effectiveness of the heat transfer is shown by Nusselt numbers. Local Nusselt numbers were averaged in the cross stream and crossflow directions to produce the area-averaged Nusselt number plots shown in FIGS. 3-5. The higher the Nusselt number, the more efficient the transfer of heat. As shown in these figures the novel variable length extended port design was the most effective of the tested designs at cooling gas turbine liners. While not wishing to be bound by this theory, it appears that by progressively increasing the length of the ports, the effect of crossflow was diminished, thereby minimizing the dilution of fresh cooling gas from the jet ports downstream by spent cooling gas that entered upstream.

As can be seen, as one goes from jet port 1 to jet port 10 (which is downstream), for all Reynolds numbers, the liner cooling became less efficient for the other designs. Also, FIGS. 3-5 show that for all Reynolds numbers, the novel variable length ports performed as well or better than the other designs tested. For the higher Reynolds numbers, the novel design performed better than the other designs.

EXAMPLE 1

A total of four port configurations were compared. Case 1 was the baseline case, Case 2 was the corrugated wall design, Case 3 was the uniform extended port design, and Case 4 was the novel variable length extended port design. In the baseline case, all jet ports were approximately flush with the shell. In the corrugated wall design case, protrusions were inserted in the channel between the shell and the liner in such a way so that gas was still allowed to flow through the channel, wherein the jet ports were approximately flush with the shell, as described by Esposito, et al, supra. In the extended port design, all jet ports were extended into the channel between the shell and the liner, wherein all jet ports were approximately the same length. For each case, three jet Reynolds numbers, $Re_d$, 20000, 40000, and 60000, were tested. Note in FIG. 2 that the shorter ports are upgradient, and the longer ports are downgradient. In Case 4, the ports varied in length from a port that was approximately flush with the outer shell to a port that was about 1.9 cm long. The port length increased progressively from the shortest to the longest in approximately equal steps of 0.19 cm.

EXAMPLE 2

FIG. 3 presents a comparison of area-averaged Nusselt number distributions for the four cases at Re=2000. Results showed adequate cooling at the first three jet rows for the baseline case. However, from the fourth row on, the baseline case appeared to be less effective, exhibiting lower Nusselt number values. Beyond the $6^{th}$ row, the Nusselt numbers clearly showed reduced cooling believed to be caused by crossflow. At the $10^{th}$ row there appeared to be very little cooling.

The corrugated wall design showed good cooling at jet rows one to nine. There was some loss of cooling for the $10^{th}$ row.

The uniform extended port design showed good cooling throughout, with some cross stream mixing.

It appears that the novel variable length extended jets design showed improved heat transfer for all ports.

EXAMPLE 3

FIG. 4 presents area-averaged Nusselt number distributions for Re=40000. The crossflow effects for the baseline case were more pronounced in this case. Heat transfer appeared to have been affected earlier by crossflow as compared to the case where Re=20000.

Crossflow effects also were seen for the corrugated wall design. Impingement core heat transfer was strongly evident with very little mixing between jets, as indicated by the lower Nusselt numbers between the holes.

The extended port design showed lower core Nusselt numbers for the early rows and higher Nusselt numbers for the downstream rows.

The variable extended port design was similar to the uniform extended port design, but it showed more impingement for downstream rows and improved heat transfer.

EXAMPLE 4

FIG. 5 presents the area-averaged Nusselt number distributions for Re=60000. The baseline case showed the effect of crossflow-related heat transfer degradation beyond the $5^{th}$ row. The corrugated wall design did not show significant enhancement in the core jet region, but that design appeared to produce almost uniform heat transfer characteristics for all 10 rows. The uniform extended port design showed good core impingement for the first 9 rows, but showed slightly lower Nusselt numbers for the $10^{th}$ row. The variable extended port design showed lower Nusselt numbers for the upstream jet ports and higher Nusselt numbers for the downstream jet ports.

The complete disclosure of all references cited in this specification are hereby incorporated by reference. In the event of an otherwise irreconcilable conflict, however, the present specification shall control.

We claim:

1. A gas turbine, comprising:

a liner disposed around a combustion chamber of the turbine engine;

a shell positioned radially outwards the liner to define an annular channel therebetween; and a plurality of ports extending through the shell to direct a coolant into the annular channel and direct the coolant from an upstream end to a downstream end of the annular channel, each port of the plurality of ports including a distal end that opens into the annular channel, the plurality of ports including a first end port proximate the upstream end and a second end port proximate the downstream end, wherein the distal end of the second end port is positioned closer to the liner than the distal end of the first end port.

2. A turbine as in claim 1, wherein the distal end of each port of the plurality of ports has an opening with a diameter between about 0.08 cm and about 3.3 cm.

3. A turbine as in claim 1, wherein the distal end of each port of the plurality of ports has an opening with a diameter between about 0.25 cm and about 2.5 cm.

4. A turbine as in claim 1, wherein the distal end of each port of the plurality of ports has an opening with a diameter between about 0.5 cm and about 1.25 cm.

5. A turbine as in claim 1, wherein a thickness of the annular channel from the upstream end to the downstream end is approximately constant.

6. A turbine as in claim 5, wherein the thickness of the annular channel is approximately 2 to 8 times a diameter of the distal end of a port of the plurality of ports.

7. A turbine as in claim 6, wherein the thickness of the annular channel is approximately 3 to 5 times the diameter of said port of the plurality of ports.

8. A turbine as in claim 1, wherein the plurality of ports include at least three ports and are arranged from the upstream end to the downstream end, and a distance between the distal end of a port of the plurality of ports to the liner decreases as a distance of the port from the upstream end increases.

9. A gas turbine, comprising:

a liner disposed around a combustion chamber of the turbine engine;

a shell positioned circumferentially around the liner to define an annular channel therebetween; and a plurality of ports extending through the shell into the annular channel, the plurality of ports having a distal end and being configured to deliver a coolant into the annular channel and direct the coolant from an upstream end to a downstream end of the annular channel, wherein the plurality of ports are arranged on the shell such that a radial distance between the distal end of a port of the plurality of ports and the liner decreases as an axial distance of the port from the upstream end increases, wherein the plurality of ports include at least three ports.

10. The gas turbine engine of claim 9, wherein the radial distance decreases linearly as the axial distance of the port from the upstream end increases.

11. The gas turbine engine of claim 9, wherein each port of the plurality of ports is one of a circumferential array of ports having the same axial distance from the upstream end.

12. The gas turbine engine of claim 9, wherein the plurality of ports include radially extending tubes that extend from the shell to the distal end.

13. The gas turbine engine of claim 12, wherein a length of a tube associated with a port of the plurality of ports increases as the axial distance of the port from the upstream end increases.

14. The gas turbine engine of claim 13, wherein the length of a tube proximate the downstream end is between about 2 times and about 3.5 times a diameter of the tube.

15. The gas turbine engine of claim 9, wherein a surface of the liner exposed to the annular chamber is corrugated.

16. The gas turbine engine of claim 9, wherein the plurality of ports have an opening diameter between about 0.25 cm to about 5.0 cm.

17. A method of impingement cooling a double walled liner of a gas turbine, the double walled liner including an inner liner surrounding a combustion chamber of the turbine engine and an outer liner positioned radially outwards the inner liner to define an annular channel, that extends from an upstream end to a downstream end, therebetween, comprising:

delivering a coolant radially into the annular channel through a plurality of ports on the outer liner such that the coolant enters the annular channel closer to the inner liner at the downstream end than at the upstream end;

directing the delivered coolant to impinge upon the inner liner; and directing the coolant to flow towards the downstream end after the impinging.

18. The method of claim 17, wherein delivering the coolant into the annular channel includes delivering the coolant through at least three ports arranged from the upstream end to the downstream end, wherein a radial distance of a port of the at least three ports to the inner liner decreases linearly as an axial distance of the port from the upstream end increases.

19. The method of claim 17, further including directing the coolant from the annular channel into the combustion chamber.

* * * * *

UNITED STATES PATENT AND TRADEMARK OFFICE

CERTIFICATE OF CORRECTION

PATENT NO. : 8,127,553 B2
APPLICATION NO. : 12/038504
DATED : March 6, 2012
INVENTOR(S) : Srinath Varadarajan Ekkad et al.

It is certified that error appears in the above-identified patent and that said Letters Patent is hereby corrected as shown below:

Title Page, item (73), should read;

Assignee: Board of Supervisors of Louisiana State University and Agricultural and Mechanical College, Baton Rouge, LA, and Solar Turbines Inc., San Diego, CA Signed and Sealed this
Third Day of July, 2012

David J. Kappos

David J. Kappos
*Director of the United States Patent and Trademark Office*